US005150654A

United States Patent [19]

Grosgebauer et al.

[11] Patent Number: 5,150,654

[45] Date of Patent: Sep. 29, 1992

[54] SPHERICAL IGNITER FOR FULL HEAD-END WEB ROCKET MOTORS

[75] Inventors: Roger A. Grosgebauer, Ogden; C. Max White, Brigham City, both of Utah

[73] Assignee: Thiokol Corporation, Ogden, Utah

[21] Appl. No.: 109,882

[22] Filed: Oct. 15, 1987

[51] Int. Cl.[5] ..... F42C 19/08

[52] U.S. Cl. ..... 102/202

[58] Field of Search ..... 102/202 APS; 60/256

[56] References Cited

U.S. PATENT DOCUMENTS

| | | | |
|---|---|---|---|
| 4,498,292 | 2/1985 | White | 102/202 |
| 4,503,773 | 3/1985 | Bolieau | 102/202 |
| 4,530,516 | 7/1985 | Adams et al. | 280/741 |
| 4,574,699 | 3/1986 | Bolieau | 102/202 |
| 4,658,578 | 4/1987 | Shaw | 60/205 |

*Primary Examiner*—Charles T. Jordan
*Attorney, Agent, or Firm*—Madson & Metcalf

[57] ABSTRACT

An igniter for full head-end web rocket motors comprises two molded urethane hemispherical shells, each of which is lined with a layer of solid propellant fuel, joined together to form a solid propellant-lined spherical pressure vessel, which spherical pressure vessel is strengthened by a wrapping fiberglass around the girth, includes an igniter initiator having an elongated tubular urethane housing that contains ignition material and serves also as a structural tie between the hemispherical shells, and a mounting foot incorporated in the lower portion of the spherical shell to facilitate bonding to the rocket motor's propellant grain, nozzle ports located in the lower portion of the spherical shell being provided for igniter flaming gas discharge and subsequent rocket motor ignition.

9 Claims, 2 Drawing Sheets

SPHERICAL IGNITER FOR FULL HEAD-END WEB ROCKET MOTORS

BACKGROUND OF THE INVENTION

1. Field of the Invention

The present invention relates to an improvement in igniters having particular utility in full head-end solid propellant rocket motors.

2. Description of the Prior Art

Conventionally, the igniter for large solid propellant rocket motors is a miniature rocket motor. Such igniters are known in the prior art as "pyrogen" igniters. A pyrogen igniter or ignition system usually is mounted in the forward or head end of the motor through a central bore or hole in the propellant.

Ongoing improvements in solid propellant mechanical properties, grain configurations, and grain analysis methods have made increases possible in volumetric loading efficiencies of solid propellant rocket motors. One grain configuration which maximizes propellant loading efficiency is the head-end web. This propellant grain design, however, having no central bore, prevents the use of conventional head-end ignition systems.

Optimization of high strength, lightweight rocket motor cases and submerged, optimized rocket motor nozzles leave little space for aft-end igniters. A form of igniter proposed in the prior art for this type of rocket motor is the lightweight consumable wafer igniter disclosed in U.S. Pat. No. 4,498,292 issued to C. Max White on Feb. 12, 1985, and assigned to the assignee of the present invention. This wafer igniter is compatible for various motor grain configurations. Under large internal motor free volume conditions, however, igniter combustion instability may occur causing the igniter to become extinguished before ignition of the rocket motor propellant is effected. Such instability stems from an inherent limitation, in a housing of wafer configuration of acceptable weight and bulk, of the pressure at which the gas producing reaction takes place.

Another form of igniter having utility for rocket motors employing head-end web solid propellants is disclosed in U.S. Pat. No. 4,503,773 which was issued on Mar. 12, 1985, to Christopher W. Bolieau and is assigned to the assignee of the present invention. U.S. Pat. No. 4,503,773 discloses a consumable igniter that is especially useful for igniting head-end web solid propellant rocket motors which have a capability of being offloaded to meet specific total impulse requirements. Such offloading is achieved by machining out propellant from the motor. Since the resulting larger free volume makes ignition of the motor more difficult, the igniter is mounted to the propellant grain, specifically in a cavity formed in the aft end surface thereof, in order to position the source of heat for ignition as close as possible to the surface to be ignited. Although not detrimental in rocket motors developed for offloading as described, the use of such a cavity is disadvantageous when it is desired to maximize propellant volumetric loading efficiency.

U.S. Pat. No. 4,530,516 issued to G. V. Adams et al., also assigned to the assignee of the present invention, discloses a housing construction for a gas generator for rapidly filling a vehicle inflatable cushion restraint system comprising stamped mating aluminum shells that are attached to each other by a hollow steel center-tie member that is provided at the center of the housing with the gas generator initiator assembly mounted therein.

A need exists for an inexpensive, lightweight consumable igniter which is operable at pressures higher than possible with wafer igniters and thus is not subject to the aforementioned combustion instability problem under large rocket motor free volume conditions, thereby to enable the use of the improvements that have been made in solid propellant mechanical properties, grain configurations and analysis methods that make possible maximization of propellant loading efficiencies. The present invention was devised to fill the technological gap that has existed in the art in these respects.

SUMMARY OF THE INVENTION

An object of the invention is to provide an improved igniter for use in rocket motors employing propellant grain configurations that enable maximization of propellant volumetric loading efficiencies.

Another object of the invention is to provide a lightweight, consumable igniter that is inexpensive to fabricate and which is adaptable to a variety of grain configurations and free volume conditions.

A further object of the invention is to provide an igniter for full head-end web rocket motors that has the characteristics of a pyrogen igniter and is operable at pressures higher than possible with wafer igniters, thus eliminating the igniter extinguishment problem.

Still another object of the invention is to provide such a lightweight, consumable igniter comprising a spherical shell that is formed by two hemispherical shells having internal linings of propellant fuel, which shells are fastened together by a tubular initiator that is provided to effect ignition of the igniter.

In accomplishing these and other objectives of the invention, there is provided an igniter for full head-end web rocket motors comprising two molded urethane hemispherical shells each of which is lined with a layer of solid propellant fuel. The hemispherical shells are joined together in any suitable manner, as by screw threads and adhesive, to form a spherical shell pressure vessel. Two layers of fiberglass tape are applied to the girth of the shell to strengthen the joined section. Nozzle ports located in the lower portion of the spherical shell are provided for igniter gas discharge and subsequent motor ignition.

An initiator which is provided to effect ignition of the igniter also serves as a structural tie between the hemispherical shells. This structural tie strengthens the spherical shell produced by the hemispherical shells sufficiently to enable operation of the igniter at a pressure sufficiently high to avoid the instability problem mentioned hereinbefore without requiring the addition of extra weight or bulk.

Igniter ignition is achieved by an ignition propagation cord and the usual safe and arming device of the rocket motor. Two ignition propagation cords are provided for redundancy.

A mounting foot is incorporated in the lower portion of the shell to facilitate bonding to the propellant grain of the rocket motor. Four stiffening webs are provided between the foot and the shell to enhance structural load distribution during rocket motor transportation, flight, and igniter ignition.

The various features of novelty which characterize the invention are pointed out with particularity in the claims annexed to and forming a part of this specification. For a better understanding of the invention, its operating advantages, and specific objects attained by its use, reference is made to the accompanying drawings and descriptive matter in which a preferred embodiment of the invention is illustrated.

DESCRIPTION OF THE DRAWINGS

With this description of the invention, a detailed description follows with reference being made to the accompanying figures of drawing which form part of the specification, in which like parts are designated by the same reference numbers, and of which.

DESCRIPTION OF THE PREFERRED EMBODIMENT

Figure 1A:
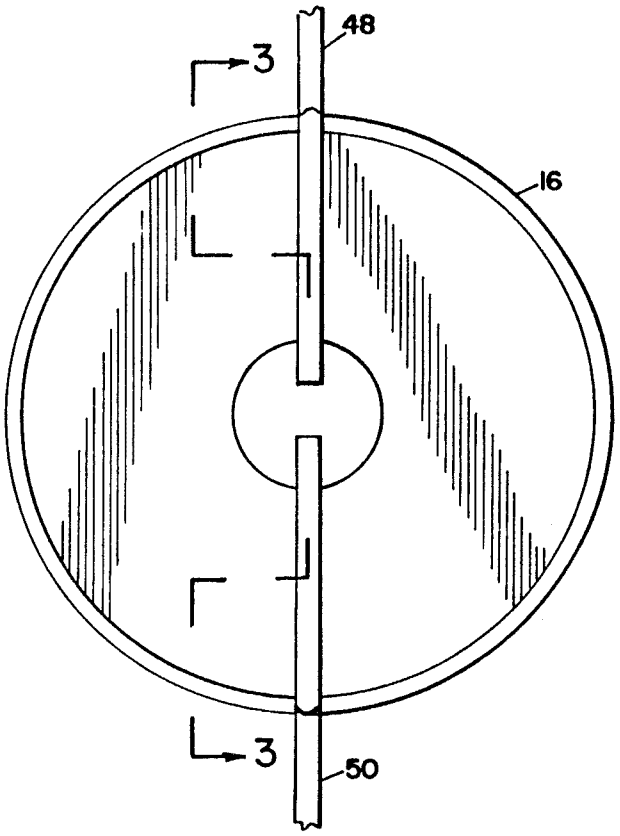
FIG. 1A is a top view of the igniter of FIG. 1.
Figure 1:
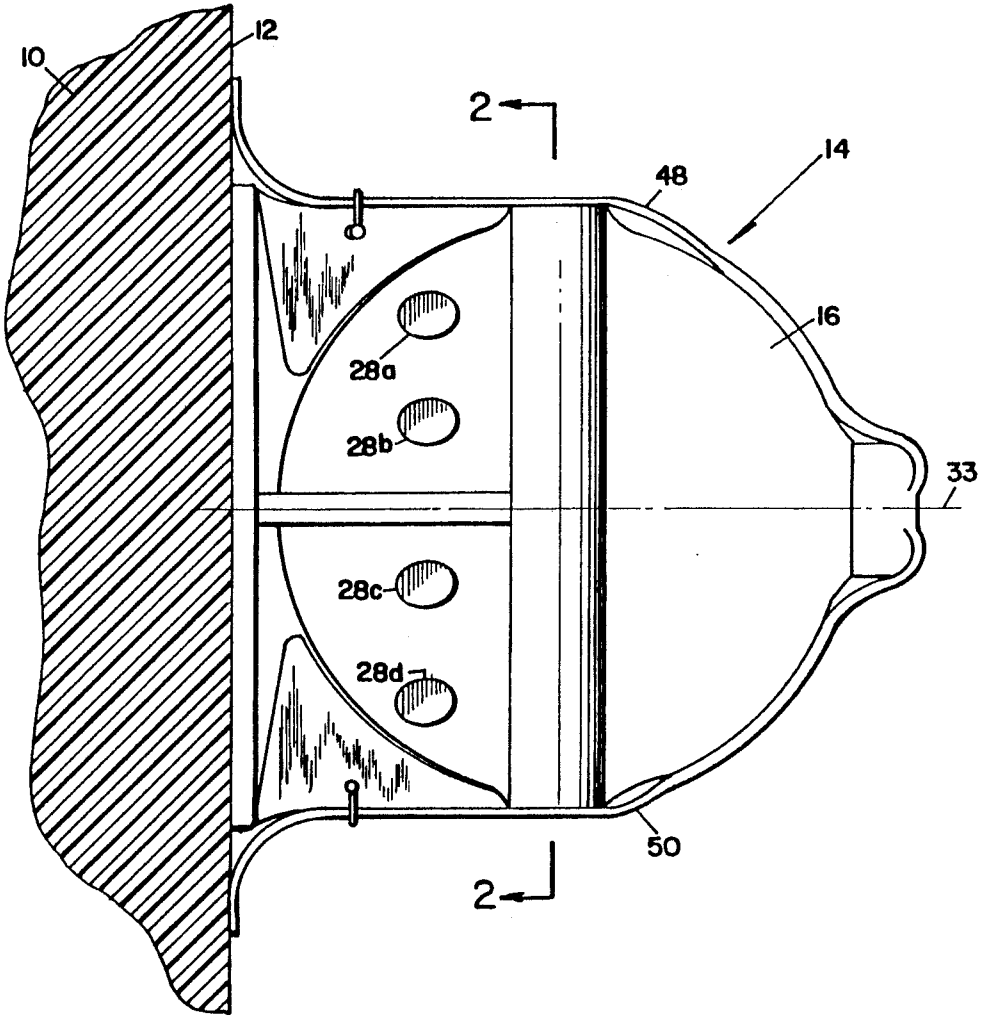
FIG. 1 is a fragmented cross sectional view of the aft end of a rocket motor head-end web propellant grain showing the improved igniter of the present invention mounted on the aft end surface thereof.

Referring to FIG. 1 of the drawings, the numeral 10 designates the aft end of a full head-end web propellant grain of a rocket motor (not shown). While not shown, the propellant grain 10 completely fills the head or forward end of the case of the rocket motor. Mounted on the aft-end surface 12 of the propellant grain 10 and bonded thereto by any suitable means is an igniter embodying the invention, indicated generally at 14. A portion at least of the aft-end surface 12 is a substantially plane or flat surface.

Figure 3:
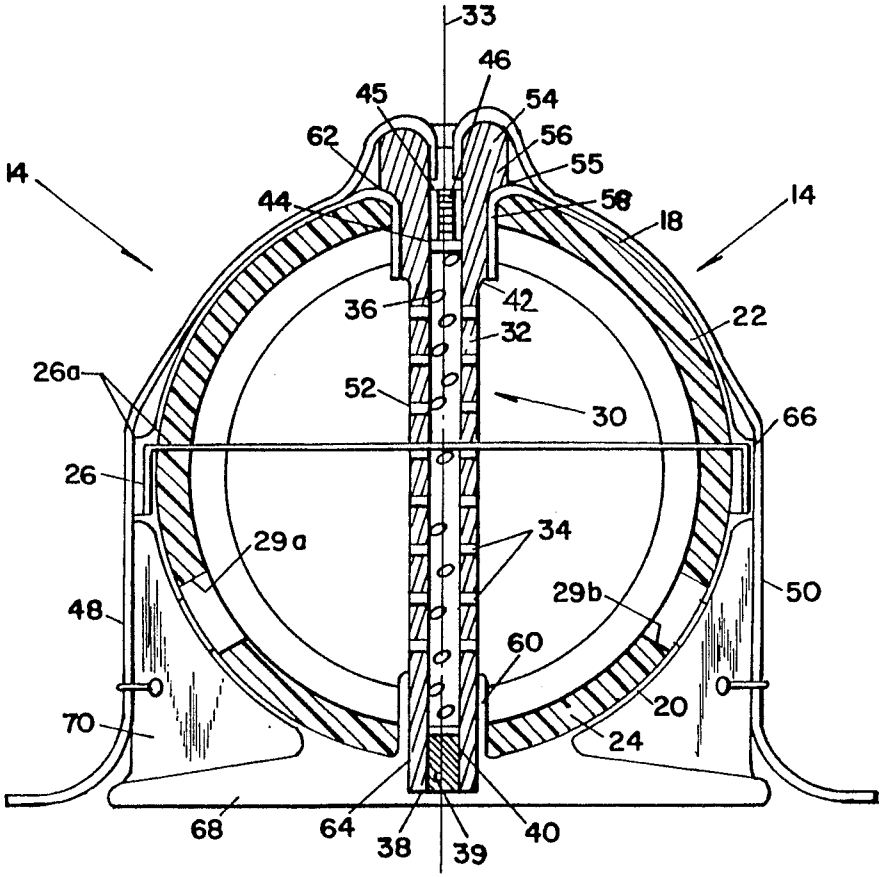
FIG. 3 is a cross sectional view of the igniter taken along the lines 3—3 of FIG. 1A.

The igniter 14 comprises a closed, rigid pressure vessel or shell 16 that is formed of two molded thin urethane hemispherical shells, a first or upper one of which is designated 18 and a second or lower one of which is designated 20, as shown in FIG. 3. Each hemispherical shell 18 and 20 is lined with a layer, designated 22 and 24, respectively, of solid propellant fuel. The hemispherical shells 18 and 20 are joined together by screw threads 26 and a suitable adhesive indicated at 26*a*.

In one embodiment of the invention in which the outer diameter of the shell 16 is about 6.4 inches (16.26 cm.) and the height thereof is about 7 inches (17.78 cm.), the thickness of each of the hemispherical shells 18 and 20 is about 0.120 inch (0.305 cm.) and the thickness of the layer of solid propellant fuel in each of the shells 18 and 20 is about 0.375 inch (0.95 centimeter). A determinant of the thickness of the shells 18 and 20 is the pressure at which the igniter 14 is intended to operate.

For sustaining ignition in a vacuum (high altitude) environment, the material of which the solid igniter propellant grain 22 and 24 is made preferably is a high-energy propellant having a rapid burning rate. A composition having particular utility for the purpose is that disclosed and claimed in U.S. Pat. No. 4,658,578 issued to Graham C. Shaw on Apr. 21, 1987 and assigned to the assignee of the present invention, and containing the following ingredients in substantially the proportions given below and also having the indicated casting properties.

| Ingredient | Percentage by Weight |
|---|---|
| Hydroxyl Terminated Polybutadiene | 12.7% |
| Acrylonitrile-Glycidol | 0.3 |
| Iron Oxide | 3.0 |
| Aluminum Powder | 10.0 |
| Ammonium Perchlorate (200 micron) | 33.0 |
| Ammonium Perchlorate (3.2 micron) | 40.0 |
| Octadecyl Isocyanate | 0.1 |
| Isophorone diisocyanate | 0.9 |
| | 100.0% |
| Casting Properties | |
| End-O-Mix - 3.2 kilopoise | |
| Pot Life - 6.5 hours | |

Figure 2:
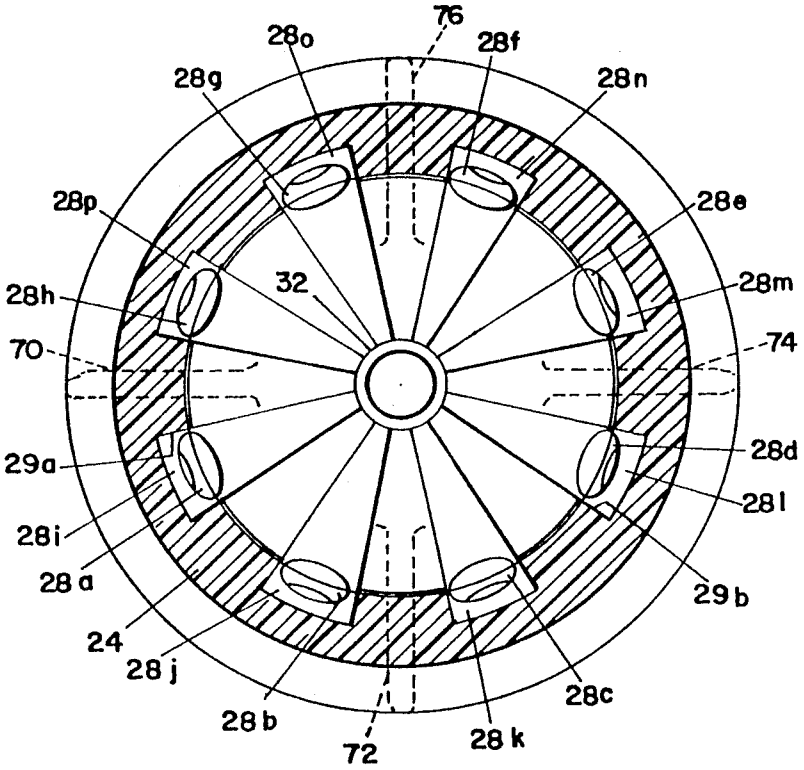
FIG. 2 is a cross sectional view of the improved igniter taken along the lines 2—2 of FIG. 1.

A plurality of nozzle ports designated by reference numerals 28*a*–28*h* are located in the lower portion of hemispherical shell 20. Ports 28*a* through 28*h* are evenly spaced about the periphery of shell 20, as best seen in FIG. 2, and are provided for igniter hot gas discharge and subsequent ignition of the motor propellant grain 10. Tapering grooves or slots 28*i*–28*p* provided in the propellant layer 24 in hemispherical shell 20 extend from a respectively associated nozzle port 28*a*–28*h* to a lowermost portion thereof. Similarly positioned and spaced apart slots may be provided in propellant layer 22 in hemispherical shell 18 thereby to make the arrangement of slots within the igniter shell 16 generally symmetrical.

For facilitating ignition, the ports 28*a* through 28*h* are each directed downwardly at an angle of about 30° toward the propellant surface 12 to be ignited. An inhibitor on the walls of each of the ports 28*a*–28*h*, as typified at 29*a* and 29*b* in FIG. 3, retards burning of the ports during the discharge of hot gas therethrough.

An initiator, indicated at 30, for igniting the solid propellant comprises an elongated tubular urethane housing 32 having a longitudinal axis 33. When initiator 30 is assembled in igniter 14, as shown in FIG. 3, the longitudinal axis 33 thereof coincides with the axis of shell 16 extending from the center of hemispherical shell 18 to the center of hemispherical shell 20.

Housing 32 has a plurality of perforations 34 in the wall thereof and is filled with pyrotechnic pellets 36. Pellets 36 comprise a booster charge and may be made of a mixture of boron and potassium nitrate. The lower end 38 of the tubular housing 32, as seen in FIG. 3, is sealed with a plug of epoxy sealant 39 which confines the pellets 36 with a styrofoam disc 40 positioned therebetween.

Pellets 36 are confined within the full length of the housing 32 by styrofoam disc 44. A charge 46 of boron and potassium nitrate granules is contained in the upper end 42 of housing 32. Charge 46 is arranged to be ignited by a Hivelite fuze 45. A Hivelite fuze is a product of Teledyne McCormick-Selph, 3601 Union Road, P.O. Box 6, Hollister, Calif. and comprises a rapidly burning material that is encased in a lead sheath having a polyethylene jacket. The pellets 36, comprising a booster charge, are initiated by two Hivelite ignition propagation cords 48 and 50, one of which only is required. The other propagation cord is provided for redundancy. The cords 48 and 50 originate at a through-bulkhead-initiator (not shown) on the case of the rocket motor (not shown).

An aluminum foil 52 wrapped around the outer cylindrical surface of the elongated tubular housing 32 normally closes the perforations 34 and, in addition to containing pellets 36 therein isolated from atmospheric conditions, perform a function of retaining gases produced within the tubular housing 32 until the pressure is great enough to project flaming gases in sufficient quantity onto the surfaces of the propellant layers 24 and 22 to effect ignition thereof.

At the upper end 42 thereof the tubular housing 32 includes an enlarged portion 54 having a shoulder 55 thereon which rests upon an extreme upper central surface portion 56 of hemispherical shell 18. The upper surface portion 56 includes a short re-entrant tubular portion 58 that extends within spherical shell 16 and serves as a guide for positioning the tubular housing 32 of initiator 30. At the extreme lower central surface portion of hemispherical shell 20, a short re-entrant tubular portion 60 also serves as a guide for positioning of the initiator 30 within the shell 16. The tubular housing 32 of initiator 30 is firmly secured to the re-entrant tubular portions 58 and 60 by suitable adhesives 62 and 64. Thus, the initiator 32 not only serves to ignite the igniter 10 but also serves as a structural tie for the two hemispherical shells 18 and 20.

For strengthening the joined section of the hemispherical shells 18 and 20, a wrapping comprising two layers 66 of fiberglass are applied to the girth of the spherical shell 16.

A mounting foot 68 for igniter 14 is incorporated in the lower portion of the spherical shell 16 to facilitate bonding of the igniter 14 to the surface 12 of the rocket motor propellant grain 10. The mounting arrangement is such that the axis 33 of the elongated tubular housing 32 of initiator 30 is substantially perpendicular to the aft-end surface 12, as best seen in FIG. 1. Four stiffening webs 70, 72, 74, and 76 are provided between the foot and the shell, as shown in FIGS. 2 and 3. These stiffening webs serve to enhance the structural load distribution during motor transportation, flight and igniter ignition.

When it is desired to ignite the rocket motor propellant grain 10, the propagation cords 48 and 50 are activated by externally initiated means, as described, to fire the Hivelite fuze 45. Fuze 45 ignites the boron and potassium nitrate granules 46 which, in turn, ignites the boron and potassium nitrate pellets 36. This produces hot gases that break through the aluminum foil 52 to ignite the layers 22 and 24 of solid propellant fuel in shell 16. The resulting ignition of the propellant layers 22 and 24 causes flaming hot gases to be discharged through the nozzle ports 28*a* through 28*h* onto the surface 12 of the rocket motor propellant grain 10, igniting the surface 12. The igniter 14 is then consumed by combustion of the propellant grain 10. Such consumption occurs before the propellant grain 10, at the location of the attachment of the igniter 14 thereto, becomes so eroded that the igniter 14 is no longer supported thereon and becomes detached therefrom.

Thus, there has been provided, according to the invention, a lightweight, consumable, and inexpensive to fabricate igniter that is adaptable to a variety of propellant grain configurations and rocket motor free volume conditions. Because the igniter has the characteristics of a pyrogen igniter, it can operate at higher pressures than wafer type igniters, thus eliminating the igniter extinguishment problem encountered in the prior art. In addition, the igniter according to the invention eliminates potential igniter-to-motor grain bond failure during igniter igniting. Being consumable, operation of the igniter leaves no debris that might cause damage to the nozzle of the rocket motor. The unique arrangement of the igniter components reduces the number of parts, eases manufacture, reduces costs and facilitates assembly.

With this description of the invention in detail, those skilled in the art will appreciate that the modifications may be made to the invention without departing from the spirit thereof. Therefore, it is not intended that the scope of the invention be limited to the specific embodiment illustrated and described. Rather, it is intended that the scope of the invention be determined by the scope of the appended claims.

What is claimed is:

1. An igniter for a rocket motor including a solid propellant having an aft-end surface, comprising:

a first plastic hemispherical shell, a second plastic hemispherical shell, said first and second hemispherical shells each being lined with a layer of solid igniter propellant fuel and joined together to form a solid propellant fuel lined spherical pressure vessel, an igniter initiator for effecting ignition of the solid igniter propellant fuel lining said spherical pressure vessel, said initiator including an elongated tubular housing having an axis, a first end, and a second end and extending through said spherical pressure vessel from substantially the center of said first hemispherical shell to substantially the center of said second hemispherical shell, said elongated tubular housing being attached at said first end thereof to said first hemispherical shell and being attached at said second end thereof to said second hemispherical shell whereby said elongated tubular housing serves as a structural tie between said first and said second hemispherical shells, and a mounting foot incorporated in said second hemispherical shell to facilitate bonding of said igniter to the aft-end surface of the rocket motor propellant with the axis of said elongated tubular housing substantially perpendicular thereto, said second hemispherical shell having a plurality of nozzle ports therein spaced about the periphery thereof for igniter gas discharge against the aft-end surface of the rocket motor propellant and subsequent ignition of said rocket motor propellant.

2. An igniter as defined by claim 1 wherein said first hemispherical shell is joined to said second hemispherical shell by screw threads and adhesive.

3. An igniter as defined by claim 2 further including a wrapping of fiberglass tape applied to the girth of the spherical shell to strenghten the joined portion of said first hemispherical shell and said second hemispherical shell.

4. An igniter as defined by claim 1 wherein the elongated tubular housing of said igniter initiator contains ignitive materials and is perforated, and includes an aluminum foil wrapped therearound.

5. An igniter as defined by claim 1 wherein said mounting foot includes a plurality of stiffening webs between said mounting foot and said spherical shell to enhance the structural load distribution.

6. An igniter as defined by claim 1 wherein said first hemispherical shell, said second hemispherical shell and said elongate tubular housing are all made of urethane, wherein said first hemispherical shell is joined to second hemispherical shell by screw threads and adhesive, wherein said igniter further includes a wrapping of fiberglass tape applied to the girth of said spherical pressure vessel to strengthen the joined portion of said first hemispherical shell and said second hemispherical shell, wherein the elongated tubular housing of said igniter initiator contains ignitive materials and is perforated, and includes an aluminum foil wrapped therearound, and wherein said mounting foot includes a plurality of stiffening webs between said mounting foot and said spherical shell to enhance the structural load distribution.

7. An igniter as defined by claim 1 wherein at least said layer of solid igniter propellant fuel lining said second plastic hemispherical shell is slotted with a slot extending from each of said nozzle ports to said second end of said igniter initiator.

8. An igniter as defined by claim 7 wherein each of said slots tapers in the direction of said igniter initiator.

9. An igniter as defined by claim 1 wherein said nozzle ports are equally spaced apart about the periphery of said second hemispherical shell, wherein at least said layer of solid igniter propellant fuel lining said second plastic hemispherical shell is slotted with a slot extending from each of said nozzle ports to said second end of said igniter initiator, and wherein each of said slots tapers in the direction of said igniter initiator.

* * * * *

UNITED STATES PATENT AND TRADEMARK OFFICE

CERTIFICATE OF CORRECTION

PATENT NO. : 5,150,654

DATED : September 29, 1992

INVENTOR(S) : Roger A. Grosgebauer and Max White

It is certified that error appears in the above-identified patent and that said Letters Patent is hereby corrected as shown below:

In the Abstract, line 6 "wrapping fiberglass" should be --wrapping of fiber glass.

Column 3, line 43 "In one embodiment" should be --In a preferred embodiment--

Column 3, line 45 "about 6,4 inches" should be --6,4 inches--

Column 3, line 46 "about 7 inches" should be --7 inches--

Column 3, line 48 "about 0.120 inches" should be --0.120 inches--

Column 3, line 49 "about 0.375 inch" should be --0.375 inch--

Column 3, line 53 "igniter propellant" should be --propellant--

Column 3, line 54 "grain 22 & 24" should be --grain 10--

Column 4, line 20 "motor propellant" should be --propellant--

Column 4, line 25 "provided in propellant layer 22" should be --provided--

Column 4, line 26 "provided in propellant layer 22" should be --provided--

Signed and Sealed this

Fifteenth Day of February, 1994

*Attest:*

Bruce Lehman

BRUCE LEHMAN

*Attesting Officer*

*Commissioner of Patents and Trademarks*